US009419325B2

(12) United States Patent
Lai et al.

(10) Patent No.: US 9,419,325 B2
(45) Date of Patent: Aug. 16, 2016

(54) SPRING ANTENNA STRUCTURE

(71) Applicant: AUDEN TECHNO CORP., Taoyuan County (TW)

(72) Inventors: Shih-Chi Lai, Miaoli County (TW); Ying-Hwei Li, Miaoli County (TW); Wei-Shuai Lin, Taoyuan County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 255 days.

(21) Appl. No.: 14/456,030

(22) Filed: Aug. 11, 2014

(65) Prior Publication Data

US 2016/0043459 A1 Feb. 11, 2016

(51) Int. Cl.
*H01Q 1/20* (2006.01)
*H01Q 1/36* (2006.01)
*H01Q 1/48* (2006.01)

(52) U.S. Cl.
CPC . *H01Q 1/20* (2013.01); *H01Q 1/36* (2013.01); *H01Q 1/48* (2013.01)

(58) Field of Classification Search
CPC ..... H01Q 1/20; H01Q 1/38; H01Q 1/48; H01Q 1/24
USPC ..... 343/720, 700 MS, 702, 841
See application file for complete search history.

(56) References Cited

U.S. PATENT DOCUMENTS 8,325,091 B2 * 12/2012 Li ..... H01Q 1/38 343/700 MS
8,711,054 B2 * 4/2014 Wu ..... H01Q 1/243 343/702
9,112,274 B2 * 8/2015 Cheng ..... H01Q 9/42
2003/0189522 A1 * 10/2003 Zeilinger ..... H01Q 9/0421 343/702
2010/0164835 A1 * 7/2010 Tai ..... H01Q 1/1207 343/906
2012/0139792 A1 * 6/2012 Pan ..... H01Q 1/243 343/700 MS
2014/0327592 A1 * 11/2014 Tsai ..... H01Q 1/243 343/841

* cited by examiner

*Primary Examiner* — Huedung Mancuso
(74) *Attorney, Agent, or Firm* — Li & Cai Intellectual Property (USA) Office

(57) ABSTRACT

A spring antenna structure integrally formed by bending a metallic sheet includes a supporting portion, a grounding radiating portion, and an antenna radiating portion. Two opposite ends of the supporting portion are respectively connected to the grounding and antenna radiating portion. The grounding and antenna radiating portion are formed by bending the supporting portion in a rotating direction. A first angle ($\theta_1$) is defined between the grounding radiating portion and the supporting portion, and a second angle ($\theta_2$) is defined between the antenna radiating portion and the supporting portion. $0°<\theta_1<90°$ and $0°<\theta_2<\theta_1+90°$. When the spring antenna structure is pressed and deformed by an external force, the spring antenna structure generates a returning force for returning to the original shape.

10 Claims, 9 Drawing Sheets

SPRING ANTENNA STRUCTURE

BACKGROUND OF THE DISCLOSURE

1. Field of the Disclosure

The instant disclosure relates to an antenna structure; in particular, to a spring antenna structure.

2. Description of Related Art

Please refer to FIG. 1, which shows a side view of a conventional antenna structure 1*a*. The cross-section of the conventional antenna structure 1*a* is U-shaped. Specifically, the conventional antenna structure 1*a* has two side sheets 11*a*approximately parallel to each other and a base sheet 12*a* connecting the ends of the side sheets 11*a*. That is to say, the side sheets 11*a* are formed by respectively bending in two opposite rotating directions. However, when assembling or getting the conventional antenna structure 1*a*, the user always presses on the parallel side sheets 11*a* so as to generate two torsions respectively in two opposite directions, thus the connections of the base sheet 12*a* and the side sheets 11*a* are easily subjected to irreversible deformation. That is to say, the conventional antenna structure 1*a* does not have enough elasticity based on the construction design thereof, such that the conventional antenna structure 1*a* is easily broken.

Moreover, the improved method is disposing a frame 13*a* (e.g., sponge or plastic) between the side sheets 11*a*, thus when assembling or getting the conventional antenna structure 1*a*, the side sheets 11*a*can be supported by the frame 13*a* for preventing the side sheets 11*a* from being irreversibly deformed. However, the improved method will increase the assembly steps and the material of the antenna structure 1*a* so as to increase the cost.

To achieve the abovementioned improvement, the inventors strive through industrial experience and academic research to present the instant disclosure, which can provide additional improvement as mentioned above.

SUMMARY OF THE DISCLOSURE

One embodiment of the instant disclosure provides a spring antenna structure for solving the problems of the conventional antenna structure, such as the susceptibility of the conventional antenna structure to irreversible deformation and metal fatigue and the corresponding increased cost.

The spring antenna structure of the instant disclosure integrally formed by bending a metallic sheet, comprises: a supporting portion having a feeding point, wherein the supporting portion has a first end and an opposite second end; a grounding radiating portion connected to the first end of the supporting portion, wherein the connection of the grounding radiating portion and the supporting portion defines a first bending line, the grounding radiating portion is formed by bending the supporting portion with respect to the grounding radiating portion along the first bending line, wherein a first angle is defined between the grounding radiating portion and the supporting portion, and the first angle is $\theta_1$; and an antenna radiating portion connected to the second end of the supporting portion, wherein a connection of the antenna radiating portion and the supporting portion defines a second bending line, the antenna radiating portion is formed by bending the supporting portion with respect to the antenna radiating portion along the second bending line, wherein a second angle is defined between the antenna radiating portion and the supporting portion, the second angle is $\theta_2$, and the following formula applies regarding the first angle and the second angle: $0°<\theta_1<90°$ and $0°<\theta_2<\theta_1+90°$; wherein the spring antenna structure is provided with resilience, so that when the spring antenna structure is pressed from an original shape to a pressed shape by an external force, the spring antenna structure generates a returning force for restoring itself to the original shape.

The spring antenna structure of the instant disclosure integrally formed by bending a metallic sheet, comprises: a supporting portion having a feeding point, wherein the supporting portion has a first end and an opposite second end; a grounding radiating portion connected to the first end of the supporting portion, wherein the connection of the grounding radiating portion and the supporting portion defines a first bending line, the grounding radiating portion is formed by bending the supporting portion with respect to the grounding radiating portion along the first bending line, wherein a first angle is defined between the grounding radiating portion and the supporting portion, and the first angle is $\theta_1$, wherein the supporting portion has two legs, and the supporting portion is connected to the grounding radiating portion only via the legs, wherein the orthogonal projection of the feeding point onto the first bending line falls between the legs; and an antenna radiating portion connected to the second end of the supporting portion, wherein the connection of the antenna radiating portion and the supporting portion defines a second bending line, the antenna radiating portion is formed by bending the supporting portion with respect to the antenna radiating portion along the second bending line, wherein a second angle is defined between the antenna radiating portion and the supporting portion, and the second angle is $\theta_2$; wherein the following formula applies regarding the first angle and the second angle: $30°<\theta_1<75°$ and $30°<\theta_2<75°$; wherein the spring antenna structure is provided with resilience, so that when the spring antenna structure is pressed from an original shape to a pressed shape by an external force, the spring antenna structure generates a returning force for restoring itself to the original shape.

Base on the above, the spring antenna structure of the instant disclosure has better elasticity by the structural design, thus when the spring antenna structure is pressed to the pressed shape by the external force, the spring antenna structure generates the returning force for returning to the original shape (i.e., the angles between the portions of the spring antenna structure return to the first angle and the second angle) after the external force is withdrawn.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 2:
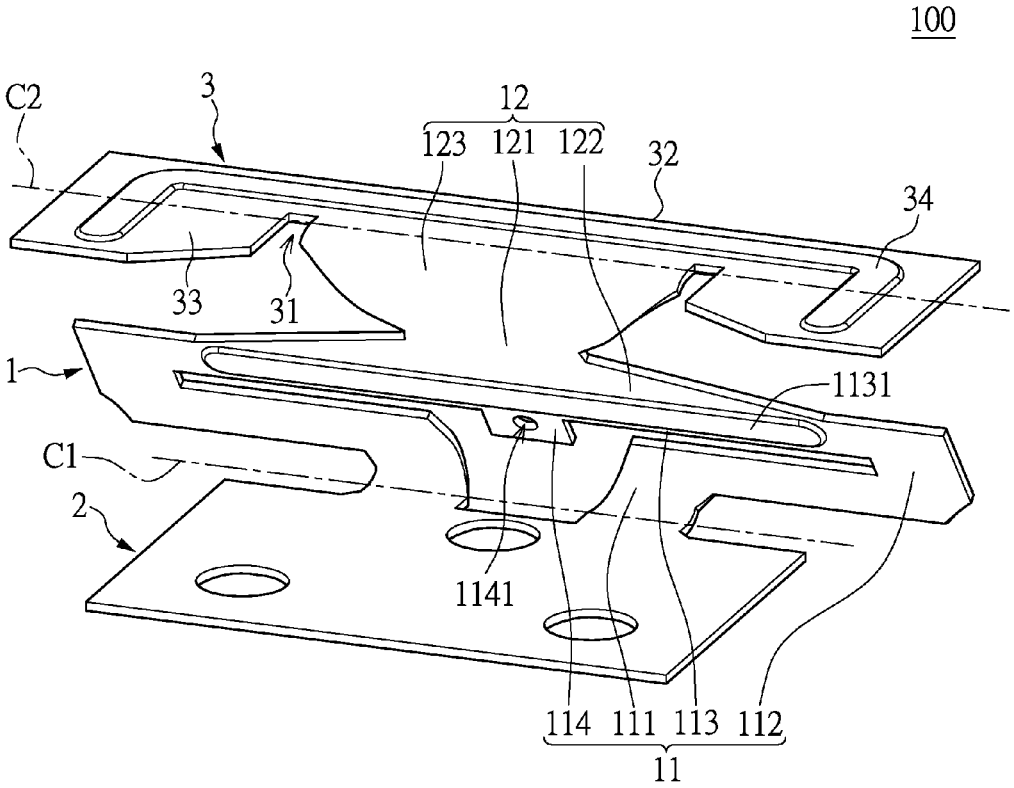
FIG. 2 is a perspective view showing a spring antenna structure according to the instant disclosure.
Figure 3:
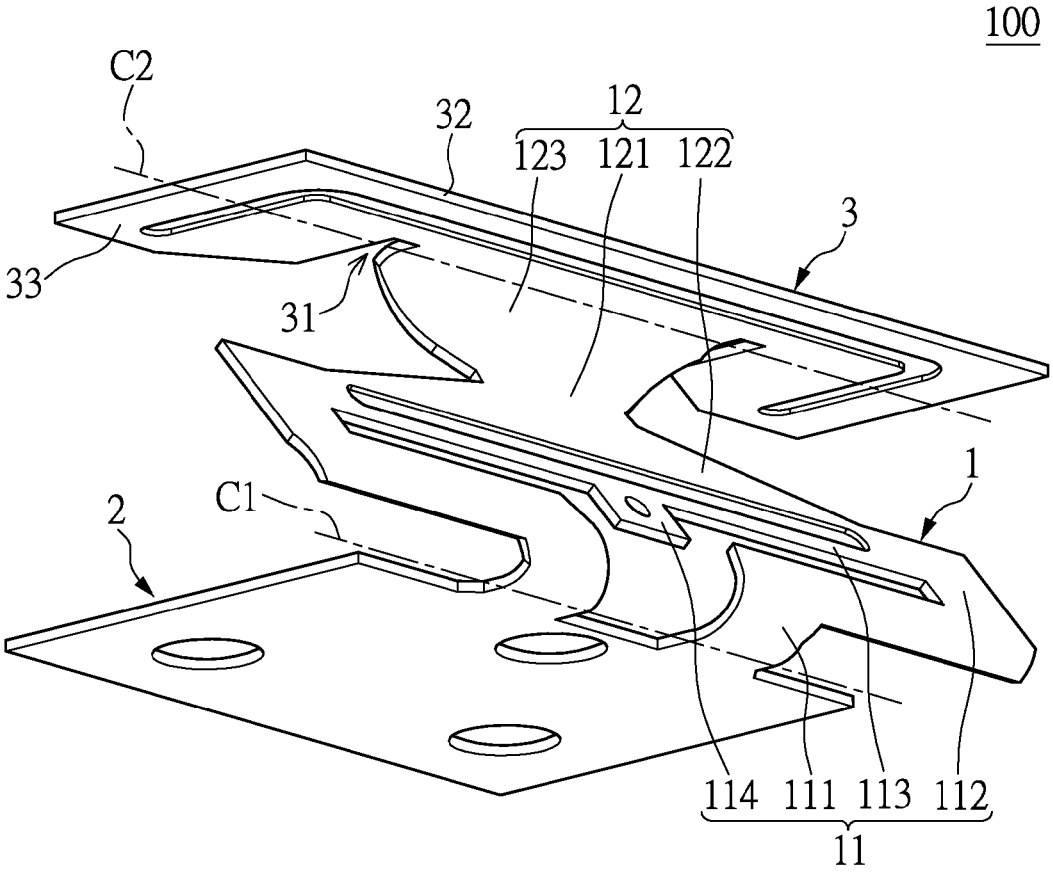
FIG. 3 is a perspective view showing the spring antenna structure in another viewing angle according to the instant disclosure.

Please refer to FIGS. 2 and 3, which show an embodiment of the instant disclosure. References are hereunder made to the detailed descriptions and appended drawings in connection with the instant disclosure. However, the appended drawings are merely shown for exemplary purposes, rather than being used to restrict the scope of the instant disclosure.

Figure 5:
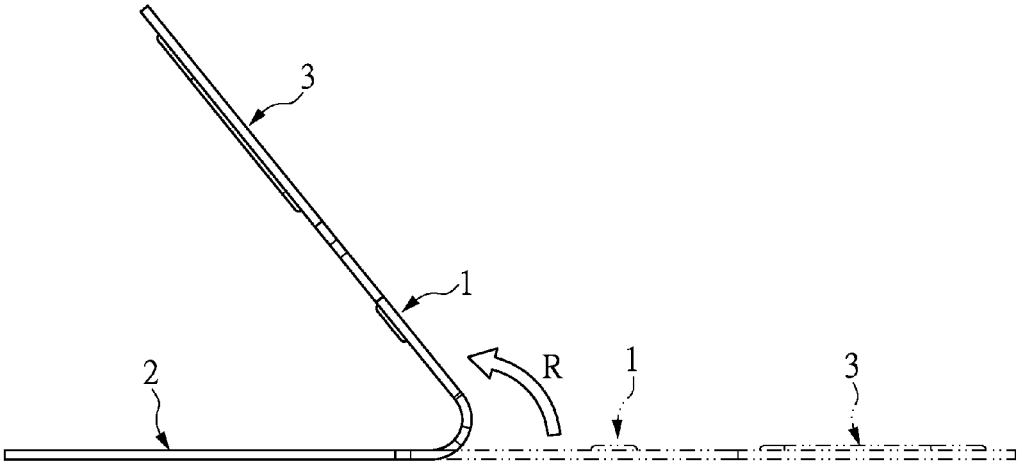
FIG. 5 is a side view showing a first bending process of the spring antenna structure.
Figure 6:
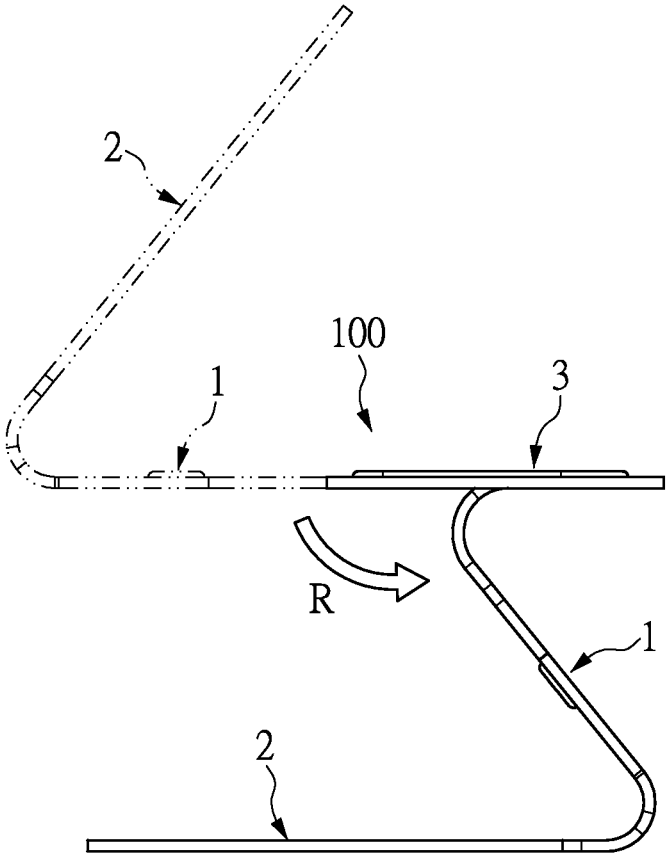
FIG. 6 is a planar view showing a second bending process of the spring antenna structure.
Figure 7:
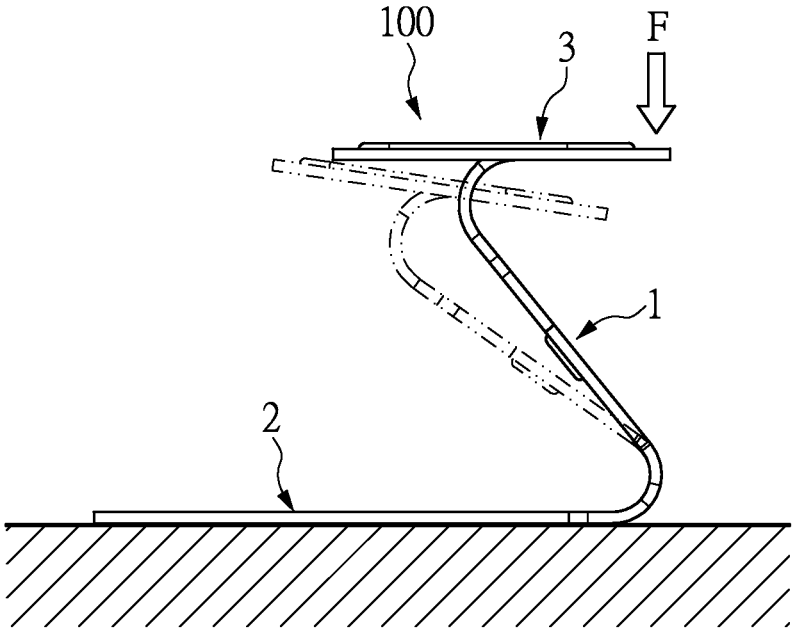
FIG. 7 is a planar view showing the spring antenna structure pressed by an external force.

The instant embodiment provides a spring antenna structure 100 being integrally formed in one piece by bending a metallic sheet (as shown in FIGS. 5 and 6). The spring antenna structure 100 is provided with resilience, so that when the spring antenna structure 100 is pressed and deformed by an external force F (as shown in FIG. 7), the spring antenna structure 100 generates a returning force for returning to the original shape. One possible construction of the spring antenna structure 100 is disclosed as follows.

Figure 4:
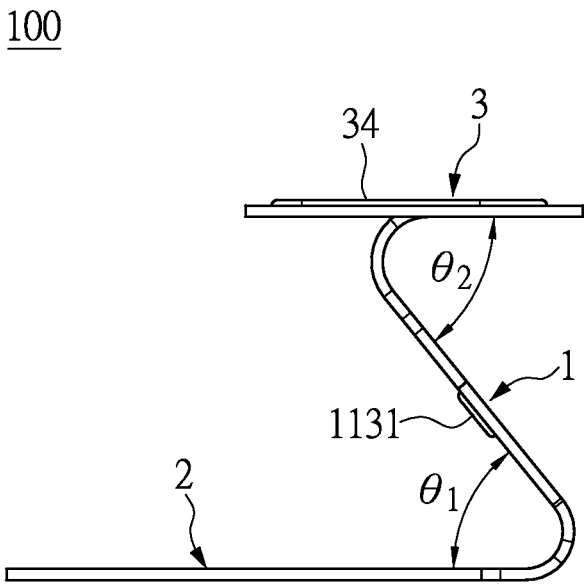
FIG. 4 is a side view of FIG. 1.

Please refer to FIG. 2 through FIG. 4. The spring antenna structure 100 has a supporting portion 1, a grounding radiating portion 2, and an antenna radiating portion 3. The supporting portion 1 has a first end (i.e., the bottom end of the supporting portion 1 as shown in FIG. 2) and an opposite second end (i.e., the top end of the supporting portion 1 as shown in FIG. 2), and the first end and the second end of the supporting portion 1 are respectively connected to the grounding radiating portion 2 and the antenna radiating portion 3. The first end and the second end of the supporting portion 1 in the instant embodiment are curved.

Moreover, the connection of the grounding radiating portion 2 and the supporting portion 1 defines a first bending line C1, and the connection of the antenna radiating portion 3 and the supporting portion 1 defines a second bending line C2. The first bending line C1 in the instant embodiment is substantially parallel to the second bending line C2, in other words, the first and second bending lines C1, C2 are substantially and lie in the same plane,but is not limited thereto.

Specifically, the grounding radiating portion 2 is formed by bending the supporting portion 1 with respect to the grounding radiating portion 2 along the first bending line C1 in a rotating direction R (i.e., the counter-clockwise direction as shown in FIG. 5), and a first angle $\theta_1$ is defined between the grounding radiating portion 2 and the supporting portion 1. The antenna radiating portion 3 is formed by bending the supporting portion 1 with respect to the antenna radiating portion 3 along the second bending line C2 in the rotating direction R (i.e., the counter-clockwise direction as shown in FIG. 6), and a second angle $\theta_2$ is defined between the antenna radiating portion 3 and the supporting portion 1. In the instant embodiment, the above two steps of bending the supporting portion 1 with respect to the grounding radiating portion 2 and the antenna radiating portion 3, respectively, are in the same rotating direction R, so as to form the Z-shaped spring antenna structure 100.

Figure 1:
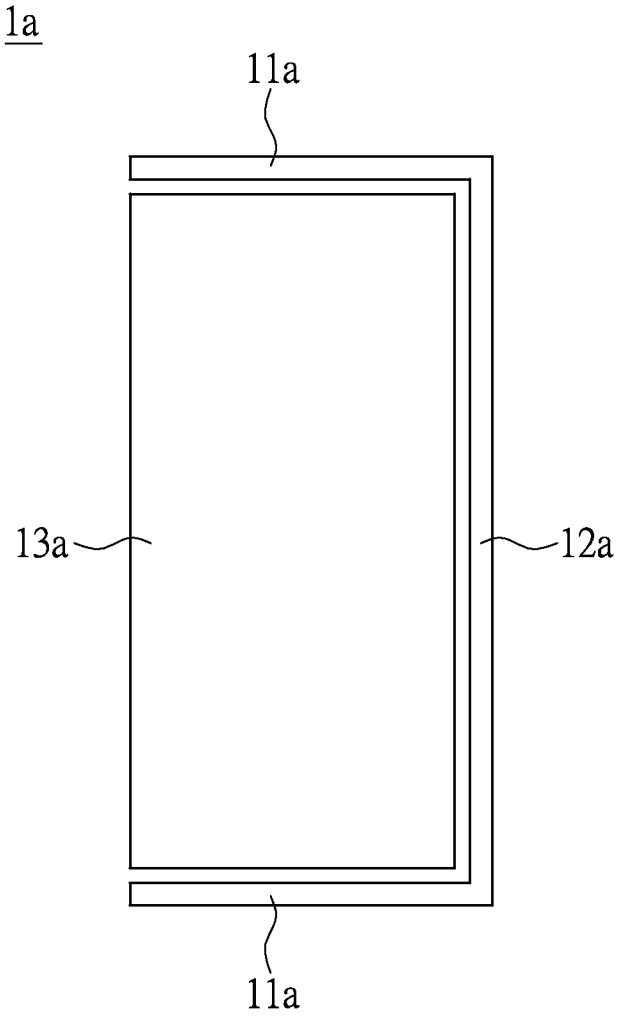
FIG.1 PRIOR ART
FIG. 1 is a side view showing a conventional antenna structure.

In more detail, the first angle $\theta_1$ and the second angle $\theta_2$ conform to the following formulas: $0°<\theta_1<90°$ and $0°<\theta_2<\theta_1+90°$, under the above conditions, the elasticity of the spring antenna structure 100 is greater than that of the conventional antenna structure (as shown in FIG. 1). Preferably, the first angle $\theta_1$ and the second angle $\theta_2$ of the instant embodiment conform to the following formulas: $30°<\theta_1<75°$ and $30°<\theta_2<75°$. The grounding radiating portion 2 in the instant embodiment is approximately parallel to the antenna radiating portion 3, and the first angle $\theta_1$ is identical to the second angle $\theta_2$.

Thus, the spring antenna structure 100 has better elasticity based on the above construction design. When the spring antenna structure 100 is pressed and deformed by the external force F (i.e., the dotted line as shown in FIG. 7, that is to say, the supporting portion 1 and the antenna radiating portion 3 are displaced with respect to the grounding radiating portion 2), the spring antenna structure 100 generates the returning force for returning to the original shape (i.e., the relative angles of the portions of the spring antenna structure 100 return to the first angle $\theta_1$ and the second angle $\theta_2$) after the external force F is withdrawn.

The construction design of the spring antenna structure 100 and the relationship between the portions have been disclosed in the above description, and the following description discloses the possible construction of each one of the supporting portion 1, the grounding radiating portion 2, and the antenna radiating portion 3.

Figure 8:
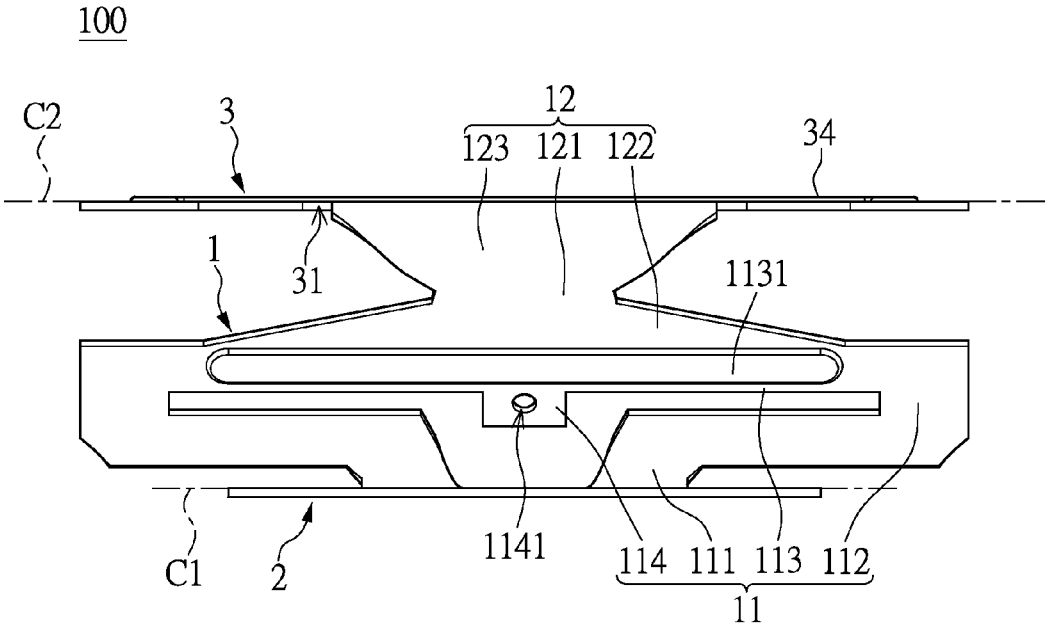
FIG. 8 is a front view of the antenna structure of FIG. 1.
Figure 9:
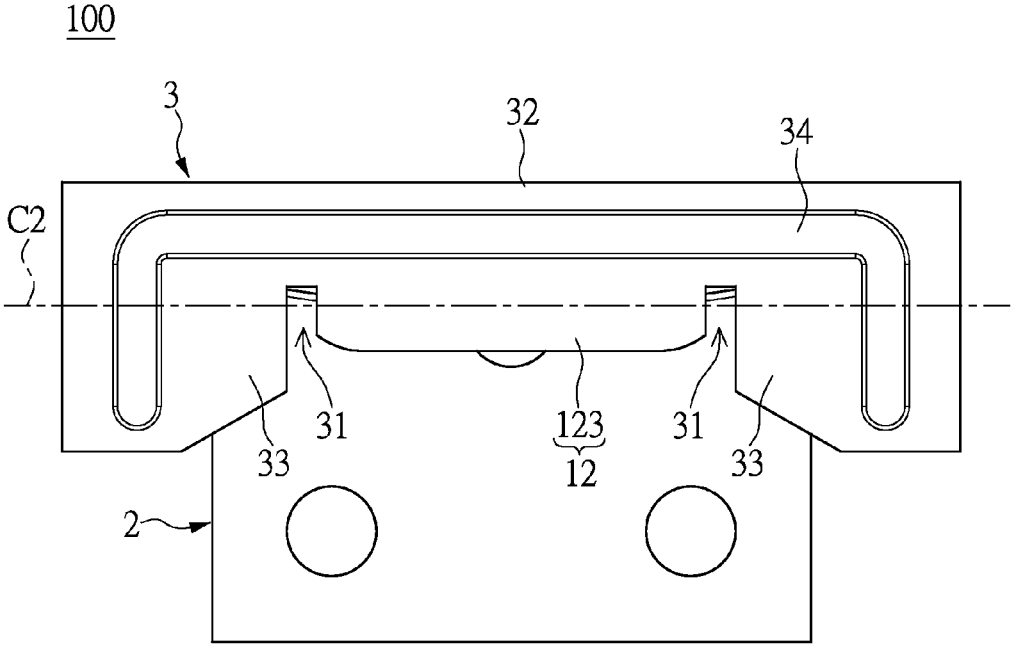
FIG. 9 is a top view of the antenna structure of FIG. 1.

Please refer to FIGS. 8 and 9, which respectively show the front view and the top view of the spring antenna structure 100. The supporting portion 1 has a first tuning portion 11 and a second tuning portion 12 connected to the first tuning portion 11. The first end and the second end are respectively arranged on the first tuning portion 11 and the second tuning portion 12. The first tuning portion 11 is connected to the grounding radiating portion 2, and the second tuning portion 12 is connected to the antenna radiating portion 3.

The first tuning portion 11 has two legs 111, two extending segments 112, a connecting segment 113, and a feeding segment 114. The first tuning portion 11 is connected to the grounding radiating portion 2 only via the legs 111. Each extending segment 112 is L shaped, and the extending segments 112 are respectively extended from the top ends of the legs 111 in two directions, in which the two directions are away from each other and then away from the grounding radiating portion 2. The connecting segment 113 having an elongated shape connects two ends of the extending segments 112 distal from the grounding radiating portion 2 (i.e., the top end of each extending segment 112 as shown in FIG. 8).

Moreover, the extending segments 112 and the connecting segment 113 are connected in a C-shape, and the feeding segment 114 is inwardly extended from the inner edge of the connecting segment 113 toward the grounding radiating portion 2. The feeding segment 114 is formed with a feeding point 1141 for providing connection of a signal wire (not shown).

It should be noted that the feeding point 1141 is arranged at the feeding segment 14 as an example, and the orthogonal projection of the feeding point 1141 onto the first bending line C1 is arranged between the legs 111 (i.e., in the middle between the legs 111). However, in practice, the feeding point 1141 can be arranged at a suitable position of the supporting portion 1 according to the designer's request, and the position of the feeding point 1141 is not limited to the figures of the instant embodiment.

Accordingly, the quantity of the leg 111 of the first tuning portion 11 connected to the grounding radiating portion 2 is two, so that the connection of the first tuning portion 11 and the grounding radiating portion 2 is more stable and has better structural strength. Two portions of the first tuning portion 11 defined between the feeding segment 114 and the legs 111, respectively, are equivalent to two parallel inductors, such that the designer can adjust the value of the inductance by changing the shape of the first tuning portion 11. Additionally, the shape and the width of the extending segments 112 and the connecting segment 113 can be changed according to the designer's demand. For example, the connecting segment 113 can be wave-shaped so as to increase the value of the inductance.

The second tuning portion 12 has a neck segment 121, a first expansion segment 122, and a second expansion segment 123. Two opposite ends of the first expansion segment 122 (i.e., the top end and the bottom end of the first expansion segment 122 as shown in FIG. 8) are respectively connected to the neck segment 121 and the connecting segment 113 of the first tuning portion 11, and the width of the first expansion segment 122 gradually increases from the neck segment 121 to the first tuning portion 11. Two opposite ends of the second expansion segment 123 (i.e., the bottom end and the top end of the second expansion segment 123 as shown in FIG. 8) are respectively connected to the neck segment 121 and the antenna radiating portion 3, and the width of the second expansion segment 123 gradually increases from the neck segment 121 to the antenna radiating portion 3. Specifically, a connective line of the first expansion segment 122 of the second tuning portion 12 and the first tuning portion 11 is longer than a connective line of the second expansion segment 123 of the second tuning portion 12 and the antenna radiating portion 3.

That is to say, the width of the second tuning portion 12 gradually increases from the neck segment 121 respectively toward the antenna radiating portion 3 and the first tuning portion 11, and the length of the top end of the second expansion segment 123 is smaller than the length of the bottom end of the first expansion segment 122. Besides, the first expansion segment 122 and the second expansion segment 123 are each a trapezoid as an example, but is not limited thereto.

Additionally, in order to enhance the structural strength of the supporting portion 1, the supporting portion 1 has a rib 1131 formed on the connecting segment 113 of the first tuning portion 11, and the rib 1131 is arranged adjacent to the connective line of the second tuning portion 12 and the first tuning portion 11. Moreover, the rib 1131 of the instant embodiment is punched from the surface of the first tuning portion 11 facing away from the grounding radiating portion 2 (the top surface of the first tuning portion 11 of the supporting portion as shown in FIG. 4). The length of the rib 1131 is substantially identical to the length of the connective line of the second tuning portion 12 and the first tuning portion 11 (i.e., the length of the bottom end of the second tuning portion 12), but is not limited thereto.

The grounding radiating portion 2 is provided for mounting on a predetermined position or element, thus the construction of the grounding radiating portion 2 can be changed according to the designer's request for easily implementing the installation of the grounding radiating portion 2. That is to say, the grounding radiating portion 2 does not have a specific construction.

The antenna radiating portion 3 is approximately a planar U shape, and the antenna radiating portion 3 is formed with a notch 31 on an inner edge thereof. The top end of the second expansion segment 123 of the second tuning portion 12 of the supporting portion 1 is connected to the inner edge of the notch 31 of the antenna radiating portion 3. Specifically, the antenna radiating portion 3 has an elongated main segment 32 and two protruding segments 33. The protruding segments 33 are respectively and integrally extended from two opposite ends of the main segment 32 (i.e., the left end and the right end of the main segment 32 as shown in FIG. 9). The protruding segments 33 are substantially arranged above the grounding radiating portion 2 (as shown in FIG. 4).

Moreover, in order to enhance the structural strength of the antenna radiating portion 3, the antenna radiating portion 3 has an U-shaped rib 34. The rib 34 is punched from the surface of the antenna radiating portion 3 adjacent to the supporting portion 1 (i.e., the bottom surface of the antenna radiating portion 3 as shown in FIG. 4). Specifically, the U-shaped rib 34 formed by punching the main segment 32 and the protruding segments 33enhances the structural strength of the antenna radiating portion 3.

[The Possible Effect of the Instant Disclosure]

In summary, the spring antenna structure of the instant disclosure has better elasticity due to the structural design, thus when the spring antenna structure is pressed and deformed by an external force, the spring antenna structure generates the returning force for returning to the original shape (i.e., the relative angles of the portions of the spring antenna structure return to the first angle and the second angle) after the external force dissipated.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A spring antenna structure integrally formed by bending a metallic sheet, comprising:

a supporting portion having a feeding point, wherein the supporting portion has a first end and an opposite second end;

a grounding radiating portion connected to the first end of the supporting portion, wherein the connection of the grounding radiating portion to the supporting portion defines a first bending line, the supporting portion is bent with respect to the grounding radiating portion along the first bending line in a rotating direction, wherein a first angle is defined between the grounding radiating portion and the supporting portion, and the first angle is $\theta_1$; and an antenna radiating portion connected to the second end of the supporting portion, wherein the connection of the antenna radiating portion to the supporting portion defines a second bending line, the supporting portion is bent with respect to the antenna radiating portion along the second bending line in the rotating direction, wherein a second angle is defined between the antenna radiating portion and the supporting portion, the second angle is $\theta_2$, the first angle and the second angle conform to the following formulas: $0° < \theta_1 < 90°$ and $0° < \theta_2 < \theta_1 + 90°$;

wherein the spring antenna structure is provided with resilience, so that when the spring antenna structure is pressed and deformed by an external force, the spring antenna structure generates a returning force for returning to an original shape.

2. The spring antenna structure as claimed in claim 1, wherein the supporting portion has a first tuning portion and a second tuning portion connected to the first tuning portion, the first end and the second end are respectively arranged on the first tuning portion and the second tuning portion, the first tuning portion is connected to the grounding radiating portion, the second tuning portion is connected to the antenna radiating portion.

3. The spring antenna structure as claimed in claim 2, wherein the second tuning portion has a neck segment, the width of the second tuning portion gradually increases from the neck segment respectively toward the antenna radiating portion and the first tuning portion, a connective line of the second tuning portion and the first tuning portion is longer than a connective line of the second tuning portion and the antenna radiating portion.

4. The spring antenna structure as claimed in claim 3, wherein the first tuning portion has a rib punched from a surface of the first tuning portion arranged away from the grounding radiating portion, wherein the rib is arranged adjacent to the connective line of the second tuning portion and the first tuning portion, the length of the rib is substantially equal to the length of the connective line of the second tuning portion and the first tuning portion.

5. The spring antenna structure as claimed in claim 1, wherein the antenna radiating portion has an elongated main segment, the supporting portion is connected to the main segment of the antenna radiating portion.

6. The spring antenna structure as claimed in claim 5, wherein the antenna radiating portion is U-shaped and is formed with a notch on an inner edge thereof, the supporting portion is connected to the inner edge of the notch, the antenna radiating portion has a rib punched from a surface of the antenna radiating portion adjacent to the supporting portion.

7. The spring antenna structure as claimed in claim 1, wherein the first bending line is substantially parallel to the second bending line, and the first angle conforms to the following formula: $30° < \theta_1 < 75°$.

8. The spring antenna structure as claimed in claim 7, wherein the grounding radiating portion is substantially parallel to the antenna radiating portion, and the first angle is identical to the second angle.

9. A spring antenna structure integrally formed by bending a metallic sheet, comprising:

a supporting portion having a feeding point, wherein the supporting portion has a first end and an opposite second end;

a grounding radiating portion connected to the first end of the supporting portion, wherein the connection of the grounding radiating portion to the supporting portion defines a first bending line, the grounding radiating portion is formed by bending the supporting portion with respect to the grounding radiating portion along the first bending line in a rotating direction, wherein a first angle is defined between the grounding radiating portion and the supporting portion, and the first angle is $\theta_1$, wherein the supporting portion has two legs, and the supporting portion is connected to the grounding radiating portion only via the legs, wherein the orthogonal projection of the feeding point onto the first bending line is arranged between the legs; and an antenna radiating portion connected to the second end of the supporting portion, wherein the connection of the antenna radiating portion to the supporting portion defines a second bending line, the antenna radiating portion is formed by bending the supporting portion with respect to the antenna radiating portion along the second bending line in the rotating direction, wherein a second angle is defined between the antenna radiating portion and the supporting portion, and the second angle is $\theta_2$; wherein the first angle and the second angle conform to the following formulas: $30° < \theta_1 < 75°$ and $30° < \theta_2 < 75°$;

wherein the spring antenna structure is provided with resilience, so that when the spring antenna structure is pressed and deformed by an external force, the spring antenna structure generates a returning force for returning to an original shape.

10. The spring antenna structure as claimed in claim 9, wherein the orthogonal projection of the feeding point onto the first bending line is arranged in the middle between the legs.

* * * * *